US010945077B2

(12) United States Patent
Scheleski et al.

(10) Patent No.: US 10,945,077 B2
(45) Date of Patent: Mar. 9, 2021

(54) ELECTROACOUSTIC TRANSDUCER WITH IMPROVED SHOCK PROTECTION

(71) Applicant: Knowles Electronics, LLC, Itasca, IL (US)

(72) Inventors: Richard Scheleski, Naperville, IL (US); Shehab Albahri, Hanover Park, IL (US); Adela Qian, JiangSu (CN)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 16/236,383

(22) Filed: Dec. 29, 2018

(65) Prior Publication Data

US 2019/0208326 A1 Jul. 4, 2019

Related U.S. Application Data

(60) Provisional application No. 62/612,340, filed on Dec. 30, 2017.

(51) Int. Cl.

| | |
|---|---|
| ***H04R 9/04*** | (2006.01) |
| ***H04R 11/02*** | (2006.01) |
| ***H04R 9/02*** | (2006.01) |

(52) U.S. Cl.

CPC ..... *H04R 9/043* (2013.01); *H04R 9/025* (2013.01); *H04R 11/02* (2013.01); *H04R 2400/07* (2013.01)

(58) Field of Classification Search

CPC ..... H04R 9/043; H04R 9/045; H04R 9/046; H04R 7/16; H04R 2400/07; H04R 25/00

See application file for complete search history.

(56) References Cited

U.S. PATENT DOCUMENTS

| | | | |
|---|---|---|---|
| 1,871,739 | A | 8/1932 | Ringel |
| 2,143,097 | A | 1/1939 | Warneke |
| 2,994,016 | A | 7/1961 | Tibbetts et al. |
| 3,111,563 | A | 11/1963 | Carlson |

(Continued)

FOREIGN PATENT DOCUMENTS

| | | | |
|---|---|---|---|
| CN | 1452545 | A | 10/2003 |
| CN | 103364909 | A | 10/2013 |

(Continued)

OTHER PUBLICATIONS

European Patent Office; International Search Report and Written Opinion; International Application No. PCT/US2018/041921; dated Feb. 15, 2019.

(Continued)

*Primary Examiner* — Fan S Tsang
*Assistant Examiner* — Angelica M McKinney
(74) *Attorney, Agent, or Firm* — Faegre Drinker Biddle & Reath LLP

(57) ABSTRACT

An electroacoustic transducer includes an armature that is mounted for deflection between magnets where an elongated portion of the armature includes a protrusion on opposite sides thereof for limiting the deflection of the armature. The protrusions are arranged transversely with respect to the elongated portion of the armature. Among other advantages, deflection of the armature is limited to provide improved shock performance. In one example, the protrusions are located within a magnet zone of the electroacoustic transducer.

20 Claims, 3 Drawing Sheets

(56) References Cited

U.S. PATENT DOCUMENTS

| | | | | |
|---|---|---|---|---|
| 3,163,723 | A | 12/1964 | Tibbetts | |
| 3,172,022 | A | 3/1965 | Tibbetts | |
| 3,177,412 | A | 4/1965 | Carlson | |
| 3,182,384 | A | 5/1965 | Carlson et al. | |
| 3,347,991 | A | 10/1967 | Carlson | |
| 3,432,622 | A | 3/1969 | Sebesta et al. | |
| 3,531,745 | A | 9/1970 | Tibbetts | |
| 3,588,383 | A | 6/1971 | Carlson | |
| 3,617,653 | A | 11/1971 | Tibbetts et al. | |
| 3,935,398 | A | 1/1976 | Carlson | |
| 4,272,654 | A * | 6/1981 | Carlson | H04R 11/00 29/594 |
| 4,410,769 | A | 10/1983 | Tibbetts | |
| 4,473,722 | A | 9/1984 | Wilton | |
| 4,518,831 | A | 5/1985 | Stanley et al. | |
| 5,101,435 | A | 3/1992 | Carlson | |
| 5,222,050 | A | 6/1993 | Marren | |
| 5,610,989 | A | 3/1997 | Salvage | |
| 5,647,013 | A * | 7/1997 | Salvage | H04R 11/02 381/312 |
| 5,690,093 | A | 11/1997 | Schrank et al. | |
| 5,708,721 | A | 1/1998 | Salvage | |
| 6,041,131 | A * | 3/2000 | Kirchhoefer | H04R 11/02 381/397 |
| 6,075,870 | A | 6/2000 | Geschiere et al. | |
| 6,654,477 | B1 | 11/2003 | Miller | |
| 6,658,134 | B1 * | 12/2003 | van Hal | H04R 11/02 381/417 |
| 6,757,403 | B2 | 6/2004 | Urushibata et al. | |
| 7,050,602 | B2 | 5/2006 | Miller | |
| 7,103,196 | B2 | 9/2006 | Warren | |
| 7,164,776 | B2 | 1/2007 | Miller | |
| 7,203,334 | B2 | 4/2007 | Schafer | |
| 7,236,609 | B1 | 6/2007 | Tsangaris et al. | |
| 7,321,664 | B2 | 1/2008 | Van Banning et al. | |
| 7,336,797 | B2 | 2/2008 | Thompson | |
| 7,362,878 | B2 | 4/2008 | Miller | |
| 7,366,317 | B2 * | 4/2008 | Miller | H04R 11/00 381/396 |
| 7,415,125 | B2 | 8/2008 | Warren | |
| 7,443,997 | B2 | 10/2008 | Miller | |
| 7,817,815 | B2 | 10/2010 | Miller | |
| 7,860,264 | B2 | 12/2010 | Jiles | |
| 7,921,540 | B2 | 4/2011 | Jiles | |
| 7,925,041 | B2 | 4/2011 | Jiles | |
| 7,995,789 | B2 | 8/2011 | Tsangaris et al. | |
| 8,027,492 | B2 | 9/2011 | Miller | |
| 8,233,646 | B2 | 7/2012 | Lutz | |
| 8,494,209 | B2 | 7/2013 | Miller | |
| 8,824,726 | B2 | 9/2014 | Miller | |
| 8,837,755 | B2 | 9/2014 | Jiles | |
| 9,137,605 | B2 | 9/2015 | Manley | |
| 9,137,610 | B2 | 9/2015 | Jiles | |
| 2002/0003890 | A1 | 1/2002 | Warren | |
| 2006/0140436 | A1 | 6/2006 | de Moel et al. | |
| 2006/0239488 | A1 | 10/2006 | Geschiere et al. | |
| 2007/0036378 | A1 | 2/2007 | Saltykov | |
| 2009/0147983 | A1 | 6/2009 | Jiles | |
| 2010/0054509 | A1 * | 3/2010 | Thompson | H04R 11/02 381/312 |
| 2012/0008814 | A1 | 1/2012 | Alwicker et al. | |
| 2012/0286865 | A1 | 11/2012 | Chandrasekaran | |
| 2013/0279732 | A1 | 10/2013 | Sanecki et al. | |
| 2014/0369548 | A1 | 12/2014 | Manley et al. | |
| 2015/0036831 | A1 | 2/2015 | Klippel | |
| 2015/0086049 | A1 | 3/2015 | Jiles | |
| 2015/0110338 | A1 | 4/2015 | McCratic | |
| 2015/0201293 | A1 | 7/2015 | Sanecki et al. | |
| 2015/0249889 | A1 | 9/2015 | Iyer et al. | |
| 2015/0373456 | A1 | 12/2015 | Dayton | |
| 2016/0227328 | A1 | 8/2016 | Van Halteren et al. | |
| 2019/0007768 | A1 * | 1/2019 | Kim | H04R 1/1083 |
| 2019/0306610 | A1 * | 10/2019 | Kim | H04R 1/1083 |
| 2020/0154212 | A1 | 5/2020 | Albahri et al. | |

FOREIGN PATENT DOCUMENTS

| | | | |
|---|---|---|---|
| CN | 203840067 | | 9/2014 |
| CN | 203840177 | | 9/2014 |
| CN | 203840179 | | 9/2014 |
| CN | 203840180 | | 9/2014 |
| CN | 203872027 | | 10/2014 |
| CN | 203933199 | | 11/2014 |
| CN | 203951282 | | 11/2014 |
| CN | 203951286 | | 11/2014 |
| CN | 203951601 | | 11/2014 |
| CN | 204046390 | | 12/2014 |
| CN | 204046391 | | 12/2014 |
| CN | 204118999 | | 1/2015 |
| CN | 204119001 | | 1/2015 |
| CN | 204168459 | | 2/2015 |
| CN | 204291354 | | 4/2015 |
| CN | 204350281 | | 5/2015 |
| CN | 204350282 | | 5/2015 |
| CN | 204350283 | | 5/2015 |
| CN | 204350284 | | 5/2015 |
| CN | 204350285 | | 5/2015 |
| CN | 204350286 | | 5/2015 |
| CN | 105050010 | | 11/2015 |
| CN | 205584474 | | 9/2016 |
| CN | 205595924 | | 9/2016 |
| CN | 205595999 | | 9/2016 |
| CN | 205595999 | U * | 9/2016 |
| CN | 205596313 | U | 9/2016 |
| CN | 107135449 | A | 9/2017 |
| CN | 107222818 | A | 9/2017 |
| CN | 107240976 | | 10/2017 |
| CN | 107240989 | | 10/2017 |
| CN | 107241674 | | 10/2017 |
| CN | 206775740 | U | 12/2017 |
| CN | 206879090 | U | 1/2018 |
| CN | 207354540 | U | 5/2018 |
| EP | 093759 | | 10/2001 |
| EP | 0784415 | B1 | 8/2002 |
| EP | 1247427 | | 11/2003 |
| FR | 551182 | | 5/1922 |
| FR | 564941 | | 4/1923 |
| GB | 859830 | A | 1/1961 |
| JP | 2007074499 | A | 3/2007 |
| JP | 4876293 | | 2/2012 |
| WO | 2015/057519 | A1 | 4/2015 |
| WO | 2016/058637 | A1 | 4/2016 |

OTHER PUBLICATIONS

European Patent Office; International Search Report and Written Opinion; International Application No. PCT/US2017/056873; dated Mar. 19, 2018.

* cited by examiner

ELECTROACOUSTIC TRANSDUCER WITH IMPROVED SHOCK PROTECTION

RELATED APPLICATIONS

This application relates to U.S. Provisional Patent Application Ser. No. 62/612,340 filed on Dec. 30, 2017, and entitled "Electroacoustic Transducer with Improved Shock Protection," the entire contents of which is hereby incorporated by reference.

TECHNICAL FIELD

The disclosure relates generally to electroacoustic transducers and more particularly to shock protection in such transducers.

BACKGROUND

An electro-acoustic receiver typically includes a housing having a movable diaphragm that separates the housing into a back volume and a front volume. A motor is disposed in the back volume and includes an armature having a portion that deflects between spaced apart magnets in response to a signal applied to a coil disposed about the armature. The armature is linked to the diaphragm by a drive rod so that deflection of the armature moves the diaphragm. The front volume includes a port through which sound is emitted upon actuation of the diaphragm. However such receivers are susceptible to permanent damage when subject to shock. For example, the armature may be bent upon severe impact to the receiver.

DETAILED DESCRIPTION

Figure 1:
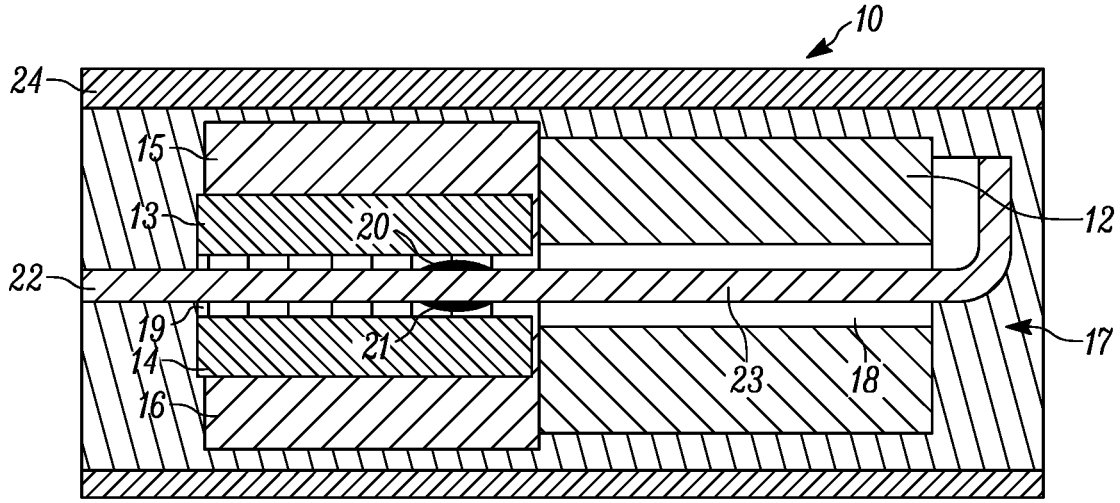
FIG. 1 is a schematic sectional view of an electroacoustic transducer with an armature in a balanced steady-state position.

In FIG. 1, an electro-acoustic transducer 10 includes a motor having an electrical coil 12, magnets 13 and 14 retained by a yoke including pole pieces 15 and 16, and an armature 17. In this example, the armature is an E-armature, but other known and future armatures may be employed in other embodiments. The magnets 13 and 14 are positioned in spaced apart relation by the yolk. The coil 12 defines a tunnel 18 aligned with a gap or space 19 between the magnets 13 and 14. The armature has an elongated portion 23 that extends through the coil tunnel 18 and at least partially into the gap between the first and second magnets 13 and 14. In balanced armature receivers, the armature is balanced between the magnets in a rest or steady state in the absence of an excitation signal applied to the coil. The armature is mounted for deflection between the magnets upon application of the excitation signal. The motor is typically disposed in a back volume of the housing and is linked to a movable portion of a diaphragm via rod or other linkage as discussed further herein.

Figure 2:
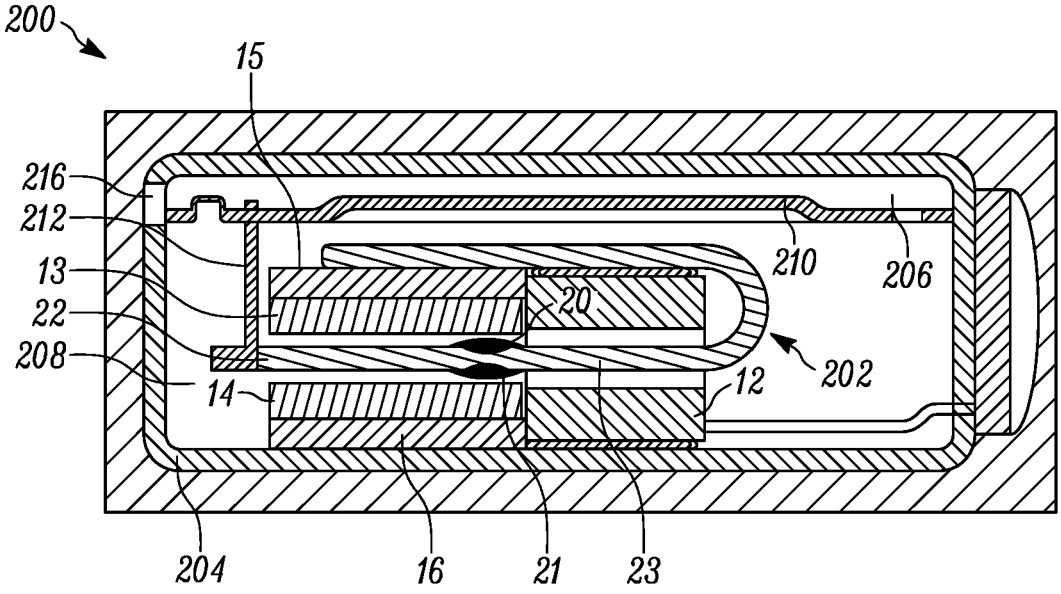
FIG. 2 is a schematic sectional view of another transducer with an armature in a balanced steady-state position.

FIG. 2 illustrates another electro-acoustic transducer 200 having a motor similar to the motor of FIG. 1 except that the armature is a U-shaped armature 202. The housing 204 is partitioned into a front volume 206 and a back volume 208 by a diaphragm 210. The motor illustrated in FIG. 1 is similarly situated. In FIG. 2, the armature 202 is also linked to a moveable portion of the diaphragm via rod 212 or other linkage. The motor includes an electrical coil 12 disposed about an armature 202 having a portion 22 that deflects between first and second magnets 13 and 14 retained by a yoke 14 upon application of an excitation signal to the coil. The motor is disposed in the back volume of the housing 204 as discussed herein. Deflection of the armature moves the diaphragm to emit sound from a sound port 216 of the housing.

In FIG. 2, an elongated portion 23 of the armature includes protrusions 20 and 21 on opposite sides thereof for limiting the deflection of the armature 17 upon impact or other shock as discussed further herein. FIGS. 2-6 also illustrate protrusions formed in or on the armature. Location of the protrusions on the armature may be more cost effective than providing protrusions or bumpers on some other portion of the transducer, like the coil or on the magnets.

Figure 5:
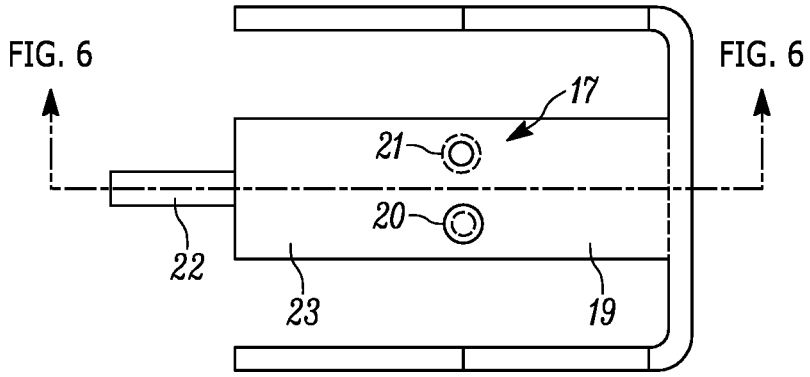
FIG. 5 is a plan view of an armature having offset protrusions arranged across a long dimension of the armature.
Figure 6:
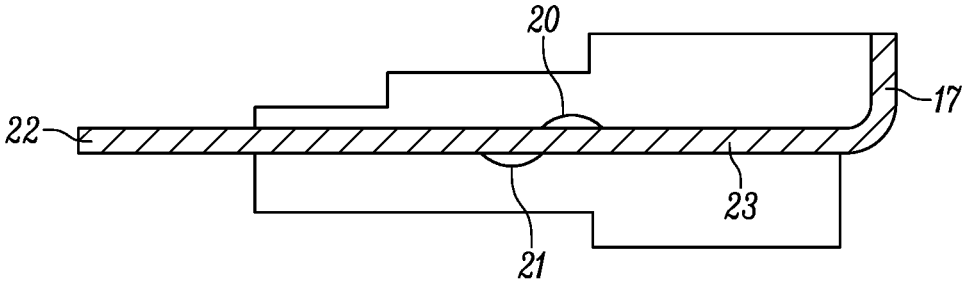
FIG. 6 is a sectional view of an armature having offset protrusions arranged along a long dimension of the armature.

In one embodiment, the protrusions are formed by a stamping or pressing operation performed on the armature. Such forming operations are cost effective and provide consistent protrusion location, size and shape. In one implementation, illustrated in FIG. 5, the pressed protrusions 20 and 21 are offset relative to each other and arranged transversely relative to a long dimension of the armature 17. The armature has a planar portion and the protrusions are stamped such that they extend from opposite sides of the armature. The protrusions in FIG. 5 have a semi-spherical shape, but the protrusions may have other shapes in other embodiments. FIG. 6 is an alternative embodiment wherein the pressed protrusions 20 and 21 are offset and arranged side-by-side along the long dimension of the armature (instead of across the armature as shown in FIG. 5).

In other embodiments, the protrusions are embodied as discrete components disposed or deposited on opposite sides of the armature to form an assembly. Such components can be embodied as parts glued, welded or otherwise fastened to opposite sides of the armature. In one example, the protrusions are lumps of settable material, like epoxy, deposited on the armature. The protrusions may also be formed by a sleeve or other member disposed about the armature. Where discrete parts are used, the protrusions need not be offset across or along the long dimension of the armature.

Generally, the protrusions are configured so that each protrusion contacts a corresponding portion of the transducer when the transducer is subject to an impact that deflects the armature beyond its normal operational range of motion (i.e., over-deflection). In some embodiments, the protrusions are located and sized so that each protrusion contacts a corresponding portion of the transducer when another corresponding portion of the armature, spaced apart from the protrusions, contacts one of the magnets upon over-deflection of the armature. Providing multiple points of contact when the armature is over-deflected in one direction or the other reduces the likelihood that the armature will be damaged (e.g., permanently bent) upon experiencing an impact or other shock. In other embodiments however the protrusions are located on the armature and sized so that only the protrusions on the armature, and no other portions of the armature, contact the transducer when the transducer is subject to shock. Various implementations are described below.

In one embodiment, the protrusions are located on the armature adjacent first and second magnets so that each protrusion contacts a corresponding magnet when the armature is over-deflected in one direction or the other. In balanced armature transducers or receivers the armature is balanced between first and second magnets in a rest or steady state (i.e., in the absence of an excitation signal applied to the coil) as shown in FIGS. 1 and 2. Thus the armature is typically located between the magnets with relatively small positional variation (i.e., a tight tolerance) compared to the positional variances of other components of the transducer. Thus configured, the protrusions provide symmetric over-deflection constraint for the armature, thereby providing proper support and optimal protection during over-deflection.

Figure 3:
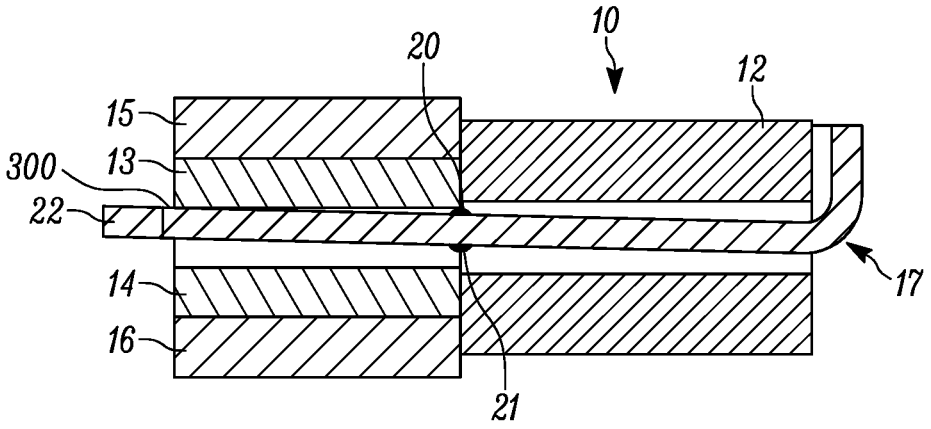
FIG. 3 is a partial sectional view of a transducer with the armature in an over-deflected upward position.
Figure 4:
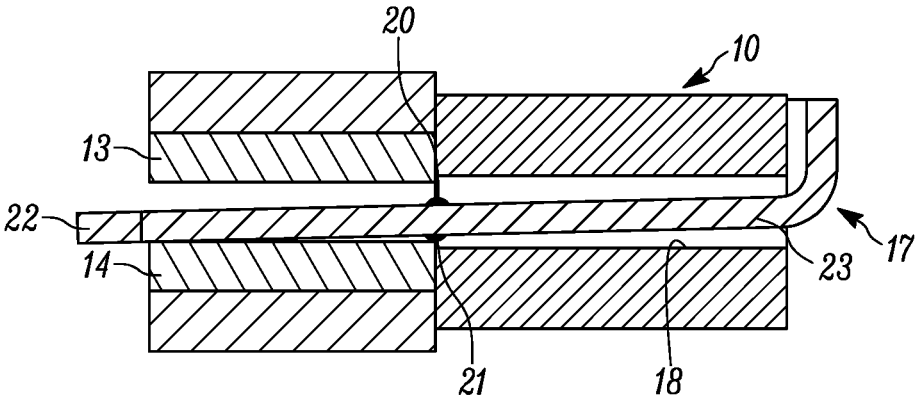
FIG. 4 is a partial sectional view of a transducer with the armature shown in an over-deflected downward position.

In FIGS. 3 and 4, the protrusions 20 and 21 of the armature respectively engage the magnets 13 and 14 when the armature is deflected upwardly and downwardly beyond its normal working range (i.e., when the armature is over-deflected). Such over-deflection would only occur when the device is subject to severe impact or shock. FIG. 3 shows a portion 300 of the armature contacting the magnet at the same time protrusion 20 contacts the magnet when the armature is over-deflected in an upward direction. Contact point 300 and protrusion 20 cooperate to provide support at multiple points along the length of the over-deflected armature which reduces the possibility that the armature can become permanently deformed or otherwise damaged. In FIG. 4, the armature is similarly supported when over-deflected in a downward direction. In other implementations however the protrusions 20 and 21 are sized or located so that only the protrusions contact the magnets without permitting the end portion of the armature (e.g., portion 300) to contact the magnets.

In some implementations, the protrusions having the same height and disposed on opposite sides of the armature are spaced a common distance from an end of the armature. Such implementations include embodiments where pressed protrusions are disposed across the long dimension of the armature as shown in FIG. 5. Protrusions having the same height will ensure a symmetric over-deflection constraint when the armature is symmetrically located between first and second magnets. Such over-deflection symmetry also facilitates supporting the armature at multiple points in embodiments where support at multiple contact points upon over-deflection is desired.

In other embodiments, the protrusions are configured to contact portions of the transducer other than the magnets when the armature is over-deflected. For example, the protrusions may be configured to contact the coil, the yoke, some structure fastened to the yoke, coil or magnets. Such structure could be embodied as a spacer between the coil and the magnet or yoke among other portions of the transducer. Selection of contact points between which the armature is substantially symmetrically located will ensure substantially symmetrical constraints on the range of over-deflection in both directions. However asymmetry between the armature and contact points on the transducer may be compensated by configuring the protrusions with different heights or locations along the armature.

In alternative embodiments the protrusions are located on the armature adjacent to the coil, instead of adjacent to the magnets, so that the protrusions contact the coil when the armature is over-deflected in one direction or the other. In these embodiments, optimal performance will be obtained if the armature is positioned symmetrically within a tunnel of the coil. Since the coil does not otherwise require precise location relative to the armature, additional coil alignment steps may be required during assembly to implement this embodiment. Alternatively, the protrusions may have different heights to compensate for a lack of symmetry between the coil and armature.

In other implementations, the protrusions on opposite sides of the armature are spaced different distances from the end of the armature. Such embodiments include pressed protrusions offset or arranged along the long dimension of the armature, as shown in FIG. 6. In these embodiments, the protrusions must have different heights if symmetry of the over-deflection constraints is desired since one of the longitudinally offset protrusions will contact some portion of the transducer (e.g., the magnet or coil) before the other protrusion when deflected occurs in one direction or the other. In embodiments where it is desirable to support the armature at multiple points upon over-deflection, the longitudinally offset protrusions must be sized so that each protrusion contacts a corresponding portion of the transducer at the same time the other portion of the transducer (e.g., portion 300 in FIG. 3) contacts the magnet when the armature is over-deflected.

While the present disclosure and what is presently considered to be the best mode thereof has been described in a manner that establishes possession by the inventors and that enables those of ordinary skill in the art to make and use the same, it will be understood and appreciated that there are many equivalents to the exemplary embodiments disclosed herein and that myriad modifications and variations may be made thereto without departing from the scope and spirit of the disclosure, which is to be limited not by the exemplary embodiments but by the appended claims.

What is claimed is:

1. An electroacoustic transducer comprising:

first and second permanent magnets retained in spaced apart relation by a yoke;

a coil having a tunnel aligned with a space between the magnets; and an armature having an elongated portion that extends through the coil tunnel and at least partially between the first and second magnets, the armature mounted for deflection between the magnets in response to an excitation signal applied to the coil, the elongated portion of the armature includes a stamped protrusion on opposite sides thereof, the stamped protrusions offset relative to each other and arranged transversely with respect to a long dimension of the armature, wherein the stamped protrusions contact a portion of the transducer when the transducer is subject to impact.

2. The transducer of claim 1, wherein the stamped protrusions are positioned adjacent the first and second magnets, wherein each stamped protrusion contacts a corresponding magnet when the transducer is subject to impact.

3. The transducer of claim 2, wherein the armature is planar and is symmetrically disposed between the first and second magnets, the stamped protrusions on opposite sides of the armature have a common height and are spaced a common distance from an end of the armature.

4. The transducer of claim 2, further comprising a housing partitioned into a back volume and a front volume by a diaphragm, the armature coupled to a movable portion of the diaphragm, wherein deflection of the armature causes the movable portion of the diaphragm to emit sound from a port of the housing via the front volume.

5. The transducer of claim 1, wherein the armature is symmetrically disposed between portions of the transducer and the stamped protrusions are configured to contact the portions of the transducer between which the armature is symmetrically disposed when the transducer is subject to impact.

6. The transducer of claim 5, wherein the armature is supported at multiple points when one of the stamped protrusions contacts one of the portions of the transducer between which the armature is symmetrically disposed.

7. An electroacoustic transducer comprising:

first and second magnets mounted in spaced apart relation;

a coil having a tunnel disposed therethrough and aligned with the space between the magnets; and an elongated armature extending through the coil, the armature having a portion deflectable between the first and second magnets, the elongated portion of the armature including a protrusion on opposite sides thereof for limiting movement of the armature, wherein the protrusions are located and sized so that each protrusion contacts a corresponding portion of the transducer at a same time another portion of the armature contacts the first or second magnet when the transducer is over-deflected.

8. The transducer of claim 7, wherein the protrusions are located adjacent to the first and second magnets, wherein the protrusions contact the magnets when the transducer is over-deflected.

9. The transducer of claim 8, wherein the protrusions are deformations formed in the armature, and the protrusions are offset relative to each other and positioned transversely with respect to a long dimension of the armature.

10. The transducer of claim 9, wherein the armature is located symmetrically relative to the first and second magnets, and the protrusions have a common height and are positioned a common distance from an end of the armature.

11. The transducer of claim 10, further comprising a housing having a front volume and a back volume separated by a diaphragm, and a link interconnecting a movable portion of the diaphragm and the armature, wherein the magnets, coil and armature form a motor disposed in the back volume of the housing armature.

12. The transducer of claim 7, wherein the protrusions include lumps of settable material deposited on the armature.

13. The transducer of claim 7, wherein the protrusions are discrete bodies disposed on opposite sides of the armature and positioned a common distance from an end of the armature.

14. The transducer of claim 13, wherein the discrete bodies have a common height.

15. An electroacoustic transducer comprising:

a yoke retaining first and second magnets in spaced apart relation;

an electrical coil having a passage aligned with a space between the first and second magnets;

an armature having an elongated portion extending through the passage of the coil and between the first and second magnets, a portion of the armature free to deflect between the first and second magnets upon application of an excitation signal to the coil;

the armature having a first pressed protrusion on a first side of the armature and a second pressed protrusion on a second side of the armature opposite the first side, the first and second pressed protrusions arranged transversely with respect to the elongated portion of the armature, the first pressed protrusion sized and positioned to contact a first portion of the transducer when a first corresponding portion of the armature contacts the first magnet, and the second pressed protrusion sized and positioned to contact a second portion of the transducer when a second corresponding portion of the armature contacts the second magnet.

16. The transducer of claim 15, wherein the armature has a planar portion with a longitudinal dimension extending through the passage and into the space between the first and second magnets, wherein the first and second pressed protrusions are formed on the planar portion across the longitudinal dimension of the armature a common distance from an end of the armature.

17. The transducer of claim 16, wherein the first and second pressed protrusions are a same size and are offset across the armature.

18. The transducer of claim 15, wherein the armature includes a longitudinal dimension extending through the passage and symmetrically into the space between the first and second magnets, wherein the first and second pressed protrusions are formed across the longitudinal dimension a common distance from an end of the armature.

19. The transducer of claim 18, wherein the first and second pressed protrusions are a same size, the first pressed protrusion is located adjacent the first magnet, the second protrusion is located adjacent the second magnet, wherein the first pressed protrusion is contactable with the first magnet and the second pressed protrusion is contactable with the second magnet.

20. The transducer of claim 19 further comprising a housing separated into a front volume and a back volume by a diaphragm, the armature linked to a movable portion of the diaphragm, the yoke, electrical coil and armature are disposed in the back volume of the housing, wherein deflection of the armature causes the movable portion of the diaphragm to emit sound from a port of the housing via the front volume.

* * * * *